US012446669B2

(12) United States Patent
Griggs, Sr.

(10) Patent No.: US 12,446,669 B2
(45) Date of Patent: Oct. 21, 2025

(54) MULTIPURPOSE ORGANIZER BAG WITH CONFIGURABLE COMPARTMENTS

(71) Applicant: Undre Griggs, Sr., West Palm Beach, FL (US)

(72) Inventor: Undre Griggs, Sr., West Palm Beach, FL (US)

( * ) Notice: Subject to any disclaimer, the term of this patent is extended or adjusted under 35 U.S.C. 154(b) by 0 days.

(21) Appl. No.: 18/168,013

(22) Filed: Feb. 13, 2023

(65) Prior Publication Data

US 2023/0276913 A1 Sep. 7, 2023

Related U.S. Application Data

(60) Provisional application No. 63/315,553, filed on Mar. 2, 2022.

(51) Int. Cl.

| | |
|---|---|
| ***A45C 3/00*** | (2006.01) |
| ***A45C 13/02*** | (2006.01) |
| ***A45C 13/10*** | (2006.01) |
| ***A45C 13/30*** | (2006.01) |

(52) U.S. Cl.

CPC ..... *A45C 3/001* (2013.01); *A45C 13/02* (2013.01); *A45C 13/10* (2013.01); *A45C 13/1069* (2013.01); *A45C 13/1076* (2013.01); *A45C 13/30* (2013.01); *A45C 2003/002* (2013.01); *A45C 2003/007* (2013.01); *A45C 2013/1015* (2013.01)

(58) Field of Classification Search

CPC ..... A45C 3/001; A45C 13/02; A45C 13/10; A45C 13/1069; A45C 13/1076; A45C 13/30; A45C 2003/002; A45C 2003/007; A45C 2013/1015

See application file for complete search history.

(56) References Cited

U.S. PATENT DOCUMENTS 4,403,638 A * 9/1983 Baum ..... A45C 7/0086 206/316.2
5,431,265 A * 7/1995 Yoo ..... A45C 3/00 190/111
7,086,437 B1 * 8/2006 Michael ..... A45C 7/009 190/110

(Continued)

FOREIGN PATENT DOCUMENTS

CN 104643468 A * 5/2015
WO WO-2009110874 A1 * 9/2009 ..... B42F 21/00

OTHER PUBLICATIONS

Quad Speed, Amazon Basics Large DSLR Bag Review, May 25, 2017 https://www.youtube.com/watch?v=8hWo39lzb5g&t=11s (Year: 2017).*

(Continued)

*Primary Examiner* — Tri M Mai
(74) *Attorney, Agent, or Firm* — Brennan, Manna & Diamond, LLC

(57) ABSTRACT

The present invention relates to bag with configurable compartments for separately storing items. The bag is preferably a carry-all type bag having a fastener adhered to the inner walls of the bag. A plurality of dividers having fasteners along their edges are securely positioned inside the bag to create separate compartments. The size and number of compartments can be adjusted by adding/removing the dividers and changing the position of the dividers inside the bag. The dividers have a label to identify the dividers and compartments.

8 Claims, 5 Drawing Sheets

(56) References Cited

U.S. PATENT DOCUMENTS

| | | | | |
|---|---|---|---|---|
| 7,900,757 | B2 * | 3/2011 | Sisitsky | A45C 11/20 190/110 |
| 8,794,492 | B2 * | 8/2014 | Ballou | B60R 11/00 224/539 |
| 2004/0149600 | A1 * | 8/2004 | Wolter | A45C 13/02 206/223 |
| 2005/0236452 | A1 * | 10/2005 | Rose | A45C 13/02 224/653 |
| 2006/0011686 | A1 * | 1/2006 | Latham | B60R 7/04 190/102 |
| 2007/0228097 | A1 * | 10/2007 | Recanati | B60R 7/043 190/110 |
| 2010/0071814 | A1 * | 3/2010 | Crandall | A45C 11/38 150/113 |
| 2018/0279732 | A1 * | 10/2018 | Lee | A45C 13/02 |

OTHER PUBLICATIONS

Iris Klein, AmazonBasics Large DSLR Gadget Bag, Mar. 25, 2016 https://www.youtube.com/watch?v=LvQBmhgpnkk (Year: 2016).*
Jordan Keyes, AmazonBasics DSLR and Laptop Backpack Review https://www.youtube.com/watch?v=12CEB_xrf-l (Year: 2016).*
Grandads Reviews, Neewer 2-in-1 Rolling Camera Backpack Case, Nov. 1, 2019 https://www.youtube.com/watch?v=QThkHICuYMw (Year: 2019).*

* cited by examiner

MULTIPURPOSE ORGANIZER BAG WITH CONFIGURABLE COMPARTMENTS

CROSS-REFERENCE TO RELATED APPLICATION

The present application claims priority to, and the benefit of, U.S. Provisional Application No. 63/315,553, which was filed on Mar. 2, 2022, and is incorporated herein by reference in its entirety.

FIELD OF THE INVENTION

The present invention relates generally to the field of travel accessories. More specifically, the present invention relates to an organizer bag having configurable compartments in order to accommodate different items to be carried by the individual in support of an activity. The bag is preferably in the form of a modified carry-all bag that features fasteners such as hook and loop material in the bag interior that allows one or more dividers to be attached to a desired position or configuration inside the bag to create separate compartments as needed. Additionally, the users can place labels on the dividers for quick and easy identification of the compartments and their contents. The compartments are used for storing items separately in an organized and efficient manner. Accordingly, the present disclosure makes specific reference thereto. Nonetheless, it is to be appreciated that aspects of the present invention are also equally applicable to other like applications, devices and methods of manufacture.

BACKGROUND

By way of background, travel accessories such as carry-on bags, satchels, gym bags and the like are typically used by individual enthusiasts for transporting necessities to and from a fitness center, studio, office, while traveling, or at the gym. These bags are generally soft sided and made from a flexible material such as duffle bags that can also be used for carrying items for short trips, backpack hiking, and other short travel activities or overnight stays. Sporting and other athletic enthusiasts carry items such as clean clothes, workout clothes, shoes, and personal or toiletry items in a bag that are usually required to conduct a workout or for post workout. However, standard bags can let dirty clothes mix with clean ones and spills of personal cleansing products can allow other personal items to be damaged, thereby creating an unsanitary way of transporting personal items. When all the items kept inside the bag or carry all are mixed together, people may have a difficult time finding the required item at a particular time. This leads to a waste of time and effort of the users in digging through the contents of the bag. Additionally, while sifting through the bag, people may be unable to find the desired item and may end up getting frustrated. The same problem is faced by people not only with gym bags but also with conventional portable carrying bags.

To prevent the items from being mixed inside or comingled within a bag, people may use multiple small bags to separately store different kinds of personal items, clothing and other things that the individual may need during the outing. However, it can be difficult to identify which item is kept in which bag and an individual may waste a lot of time searching for a required item. Also, handling multiple small bags along with the larger bag can, at times, be difficult. Individuals may desire a bag that allows them to keep items inside the bag in a well-organized manner and so that it takes minimal time to locate any required item.

Another problem that individuals face with the standard carrying bags is that the clean clothes and dirty clothes often mix together along with personal grooming products. Also, there is a risk of unwanted odor from dirty clothes being transferred to clean clothes, or the personal care products spilling on the clothes. Once this happens, individuals may not feel fresh post workout as their clothes may not smell good, thereby leaving the individuals feeling uncomfortable as they believe others may notice the smell.

Therefore, there exists a long-felt need in the art for a modified bag that can be used to transport necessities and items in a well-organized and compartmentalized manner. There is also a long-felt need in the art for an improved bag that prevents the items kept inside the bag from unintendedly being mixed together. Additionally, there is a long-felt need in the art for a bag that eliminates the need to use several small bags to keep items separate inside the bag. Moreover, there is a long-felt need in the art for a modified carry-all bag that provides a sanitary way of transporting gym and athletic items and prevents the items from unintentionally being mixed together. Further, there is a long-felt need in the art for a modified carry-all bag that allows quick access to items kept inside the bag and therefore saves time and effort of the user. Furthermore, there is a long-felt need in the art for an improved carry-all bag that ensures the dirty clothes, clean clothes and personal grooming items are kept separate from one another preventing the transfer of bad odor from dirty to clean clothes and preventing personal care items from spilling on the clean clothes. Finally, there is a long-felt need in the art for a gym bag that is easy to use and ensures that the bag is kept neat and organized.

The subject matter disclosed and claimed herein, in one embodiment thereof, comprises a portable bag with configurable compartments. The carry-all bag enables users to store items separately in individual compartments formed by one or more dividers and to be able to reconfigure the compartments depending on the contents to be stored in the bag. The bag comprising an enclosed storage space formed by exterior walls, which include side walls, end walls, a bottom and a top, which can be closed to create an interior storage space. The interior storage space is used for receiving and accommodating one or more items. A continuous loop fastener is disposed inside the bag walls and a plurality of movable dividers are positioned inside the bag for creating several independent compartments. Each divider has a fastener such as a hook fastener or second fastener to securely fasten to a loop fastener and the dividers can be positioned and spaced apart for creating individually configurable compartments inside the bag to store items separately and independently inside the bag.

In this manner, the novel modified carry-on bag of the present invention accomplishes all of the foregoing objectives and provides a relatively convenient solution to organize items inside the bag. The modified bag of the present invention is also user friendly, as it allows the users to attach the dividers inside the bag to achieve the compartments of their desired size. Also, the users can put labels or other indicators on the dividers to identify the compartments and the contents inside each compartment. The bag of the present invention prevents the items from being inadvertently mixed together inside the bag and saves a lot of time and effort of the user when retrieving items from inside the bag.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a portable bag with a plurality of configurable compartments. The bag has a front wall, a rear wall, a pair of side walls, a bottom wall and a pivotable or moveable top wall. The walls create an enclosed storage, or interior space, for receiving and accommodating one or more items. The inner surfaces of the front wall, the rear wall and the bottom wall have a series of continuous loop fasteners. A plurality of dividers are positioned inside the bag and between the front wall, side walls and the rear wall for creating compartments. Each divider has a plurality of continuous hook fasteners to securely fasten to the loop fastener. The dividers can be positioned and spaced apart at variable distances for creating configurable compartments inside the bag to store items separately and independently inside the bag.

In yet another embodiment, the loop fastener is adhesively bonded, thermally fused or injection molded inside the bag.

In another embodiment, the loop fasteners are provided in a predetermined pattern so that preconfigured spaces can be created without needing to guess at the size. For example, a compartment created by the divider may be specifically sized to carry a pair of shoes or personal grooming components.

In a further embodiment, dividers can be provided in a number of configurations, some dividers may provide a water or moisture barrier and use a waterproof coating. Other dividers may be made of a mesh material to allow easy airflow between the compartments.

In yet another embodiment, the dividers are removably placed inside the bag for creating compartments.

In yet another embodiment, each divider has a label or other marker for identifying the divider.

In yet another embodiment, an organizer bag is disclosed. The organizer bag is used for storing items in an orderly manner and the bag includes at least two adjustable labeled compartments for storing items. The compartments are formed by positioning at least one divider inside the bag between the side walls or alternatively between the front and rear walls. The dividers can be positioned in a position that is parallel to the side walls, perpendicular to the side walls or angled to the side walls. A combination of dividers may be positioned such that some walls run parallel and others are perpendicular or angled. The divider is secured inside the bag using a first and second fastener system and the bag has first fasteners disposed inside therein and the divider has second fastener along at least a portion of the periphery of the divider, and the divider is adjusted inside the bag to change the size of the compartments.

In yet another embodiment, a method of storing dirty clothes and clean clothes inside a bag is described. The method includes the steps of providing a portable bag having configurable compartments. The portable bag having a loop fastener adhered inside therein. Next, securing at least one divider inside the bag such that the divider divides the bag in two compartments and the divider has a second, or hook fastener, that fastens to the loop fastener. Then, storing dirty clothes in one compartment and storing clean clothes in the other compartment. In yet a further step adding at least one additional divider to create an additional compartment.

In yet another embodiment, the method includes a further step of changing the position of the divider to adjust the width of the compartments.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
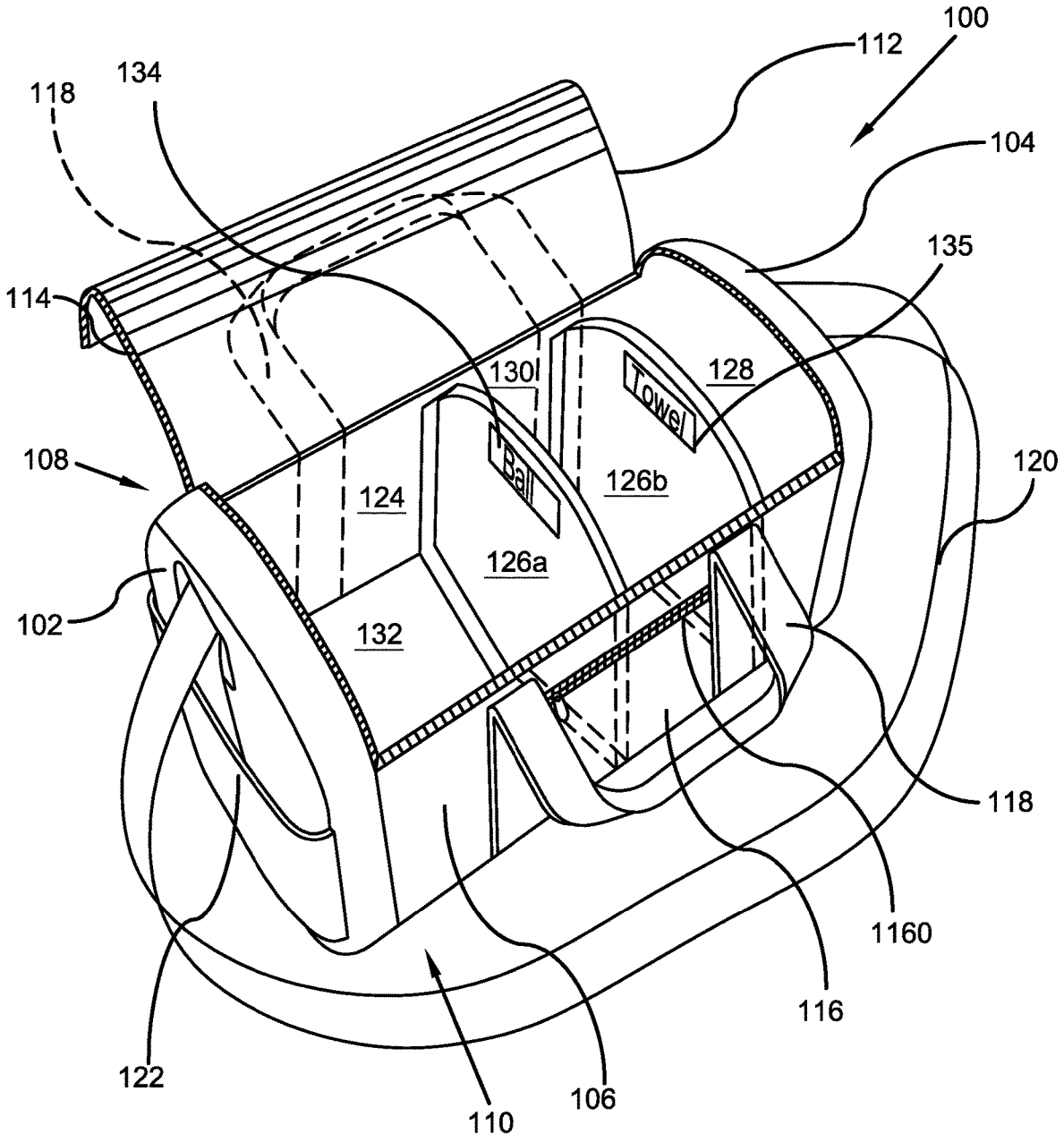
FIG. 1 illustrates a perspective view of one potential embodiment of the portable organizer bag of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a modified bag that can be used to transport necessities and items in a well-organized manner. There is also a long-felt need in the art for an improved bag that prevents the items kept inside the bag from inadvertently mixing together. Additionally, there is a long-felt need in the art for a portable bag that eliminates the need to use multiple small bags to keep items separate inside the bag. Moreover, there is a long-felt need in the art for a modified carry-all bag which provides a sanitary way of transporting athletic apparel and other items and prevents the items from being unintentionally mixed together. Further, there is a long-felt need in the art for a modified portable bag that allows quick access to items kept inside the bag and, as such, saves time and effort of the user in having to search for the desired item. Furthermore, there is a long-felt need in the art for an improved carry-all bag that ensures the dirty clothes and clean clothes are kept separate and prevents transferring of bad odor or stains from dirty to clean clothes. Finally, there is a long-felt need in the art for a portable bag that is easy to use and ensures the bag is kept neat and organized.

The present invention, in one exemplary embodiment, is a utility organizer bag. The bag is used for storing items in an orderly manner and the bag includes at least two adjustable, individual compartments for storing items. The compartments are formed by positioning at least one divider inside the bag. The divider may be secured inside the bag using a first set of hook and loop or other suitable fasteners, and the divider can be adjusted inside the bag to change the size of the various compartments. In an alternative embodiment, the fastener can be a magnetic fastener, an adhesive, a series of snap fasteners, or a rib and channel configuration in which the divider slides into the channel to secure the divider in place.

Referring initially to the drawings, FIG. 1 illustrates a perspective view of one potential embodiment of the portable organizer bag of the present invention in accordance with the disclosed specification. The carry-all organizer bag 100 of the present embodiment is designed for assisting a user in organizing athletic clothes, accessories such as shoes, personal care items and other belongings. As will be described below in more detail, the portable bag 100 is reconfigurable, in that a plurality of individual sections or compartments are created inside the bag 100 for organizing and storing a number of different items. In addition, the compartments may have a set of different pre-configured spaces to accommodate different items such as shoes, personal care items, water bottles or the like so that the space is not wasted and allows more area for clothing or other bulkier items.

More specifically, the bag 100 has a pair of side walls 102, 104, a front wall 106, a rear wall 108, a bottom panel 110 and a top panel 112. The side walls 102, 104, the front wall 106 and the rear wall 108 extend upwards from the bottom panel 110 and together with the top panel 112 form a storage compartment having an internal space or volume. The top panel 112 allows access to items stored in the storage volume or space and the top panel 112 is fastened to cover the storage area or space using a fastener 114. The fastener 114 can be one of a zipper, snap button, hook and loop fastener, magnetic fastener, rib and channel fastener and combinations thereof. Although the bag 100 is shown as a soft-sided carry all, such as a duffle bag, it should be understood that the bag 100 should be construed broadly and can encompass any bag including hard-sided luggage, back packs, and other luggage.

The bag 100 has a plurality of pockets 116 disposed on the exterior surface of one or more walls. The pockets 116 are secured by their own zipper 1160 or any other fastener for increasing storage space and for storing additional items. The bag 100 has a pair of handles 118 with a handle located on each of the front wall 106 and the rear 108 for easily carrying the bag 100 in one's hands or strung over a shoulder. Further, the bag 100 can have a central padded strap handle 120 extending between the side walls 102, 104. The side walls 102, 104 can have one or more pockets 122 for receiving small items such as a key, a cell phone, deodorant, wallet, watch and other items.

The walls 106, 108 and the bottom panel 110 in one embodiment has a fastener 124 disposed on their inner surfaces. The fastener may be provided in a continuing configuration, running from edge to edge, or provided in a pattern made from a number of spaced apart fastener elements. The fastener 124 is sewn, adhered, or permanently attached inside the bag along the inner surfaces of the walls 106, 108, 110. Alternatively, the fastener 124 can be adhesively bonded, thermally fused or injection molded inside the bag 100. The fastener 124 allows a plurality of dividers shown exemplary through numerals 126*a*, 126*b* and having a corresponding fastener (shown in FIG. 4) to be removably placed for creating the separate compartments 128, 130, 132 to organize and store belongings, clothes, personal grooming products and other accessories separately. It should be noted that although only two dividers are shown in the present embodiment, any number of dividers may be provided to create any number of desired compartments and can be removably placed inside the bag 100. The dividers can be spaced apart to create compartments of any suitable size, to customize the bag 100 as per preferences of a user and to organize and store clothes, belongings, and other items. Each compartment is supported by a divider, the inner surfaces of the front wall 106, rear wall 108 and bottom wall 110 along with another divider or a side wall. The dividers may be made from the same material or different materials. Dividers may be made from a mesh material to allow air flow, may be impervious to water, moisture, or air, may be treated with anti-microbial, anti-fungal or other protective coatings to prevent the spread of bacteria, fungus or other undesirable germs or microbes.

As illustrated, in a deployed position inside the bag 100, a divider is secured to the inner surfaces of the front wall 106, rear wall 108 and the bottom wall 110. The divider has a shape and dimension to fit the interior area of the bag and match the dimension of the bag 100, thereby not impeding the closure and opening of the bag 100. The dividers are stiff, and each divider has a label or other indica 134 (like towel, ball) for uniquely identifying the divider and associated compartment inside the bag 100. The label 134 may be inserted in a pocket 135, or a film may be used to allow the individual to use an erasable marker to change the indica on the label or film pocket 135.

The bag 100 is made of a weatherproof, tear and impact resistant material such as thermoplastic urethanes, polyurethane, polycarbonates, rubber, leather, latex, canvas, leather, and combinations thereof. Further, the bag 100 can be made of a single material or different parts of the bag 100 can be made from different materials. The bag 100 maintains the shape with the dividers 126*a-b* positioned inside the bag 100 or without the dividers. The dividers 126*a-b* can be spaced apart as per desire and preferences of a user allowing the user to store items in an organized manner.

The bag 100 is described as a portable bag, such as a gym or athletic bag, in the present embodiment and may be used to keep clean and dirty clothes in separate and distinct compartments, for example. However, other uses and shapes of the bag 100, such as using the bag for carrying books by a student, are contemplated in the present invention.

Figure 2:
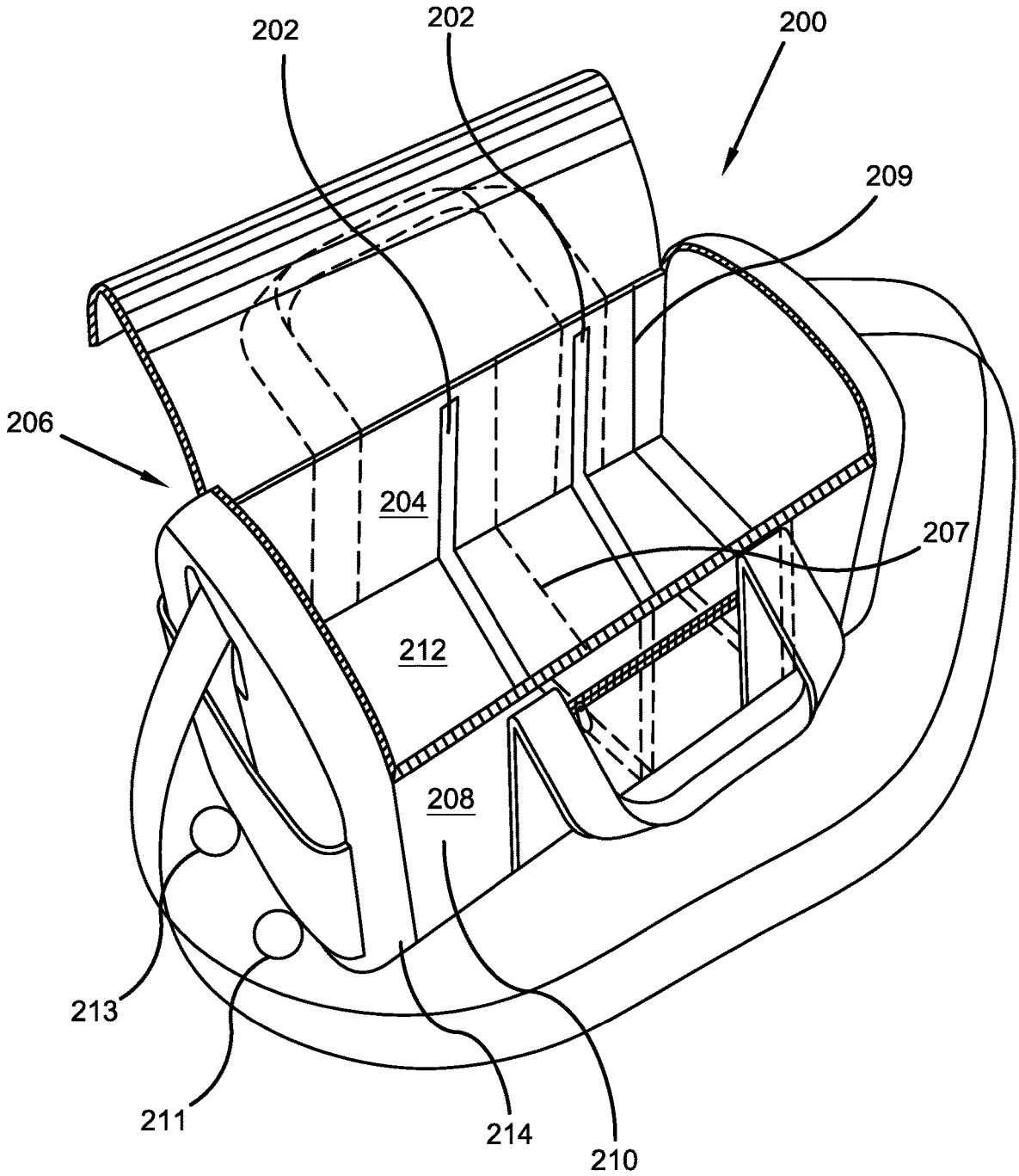
FIG. 2 illustrates a perspective view of another embodiment of the portable organizer bag not equipped with the dividers in accordance with the disclosed architecture.

FIG. 2 illustrates a perspective view showing another embodiment of the reconfigurable organizer bag shown without the dividers in accordance with the disclosed specification. In the present embodiment, the portable bag 200 has substantially the same shape and dimensions as the bag described in FIG. 1, but the first fasteners 202 are positioned on the inner surface 204 of the rear wall 206, inner surface 208 of the front wall 210 and inner surface 212 of the bottom wall 214 in a spaced apart and generally rectangular panel, and are not disposed along the entire inner surfaces of the walls 206, 210, 214.

The predefined positioning of the fastener 202 allows a user to securely place the dividers along the first fastener 202 to make compartments. The portable bag 200 is useful for people who desire and need compartments of specific size and width. The first fastener 202 is shown in a continuous pattern, whereas the fastener 207 is provided in a pattern with spaced apart fastening agents, such as spaced a distance of 1 to 2 inches apart, on the interior of the bag 100. In addition, the fastener 205 may provide a pre-configured space which is a width of a specific item such as a personal grooming product, brush, shoes or other items and in this way, such items do not occupy more space than is required for such items. The bag 100 is also shown with wheels 211 and 213 to allow the bag to be rolled along behind the individual.

Figure 3:
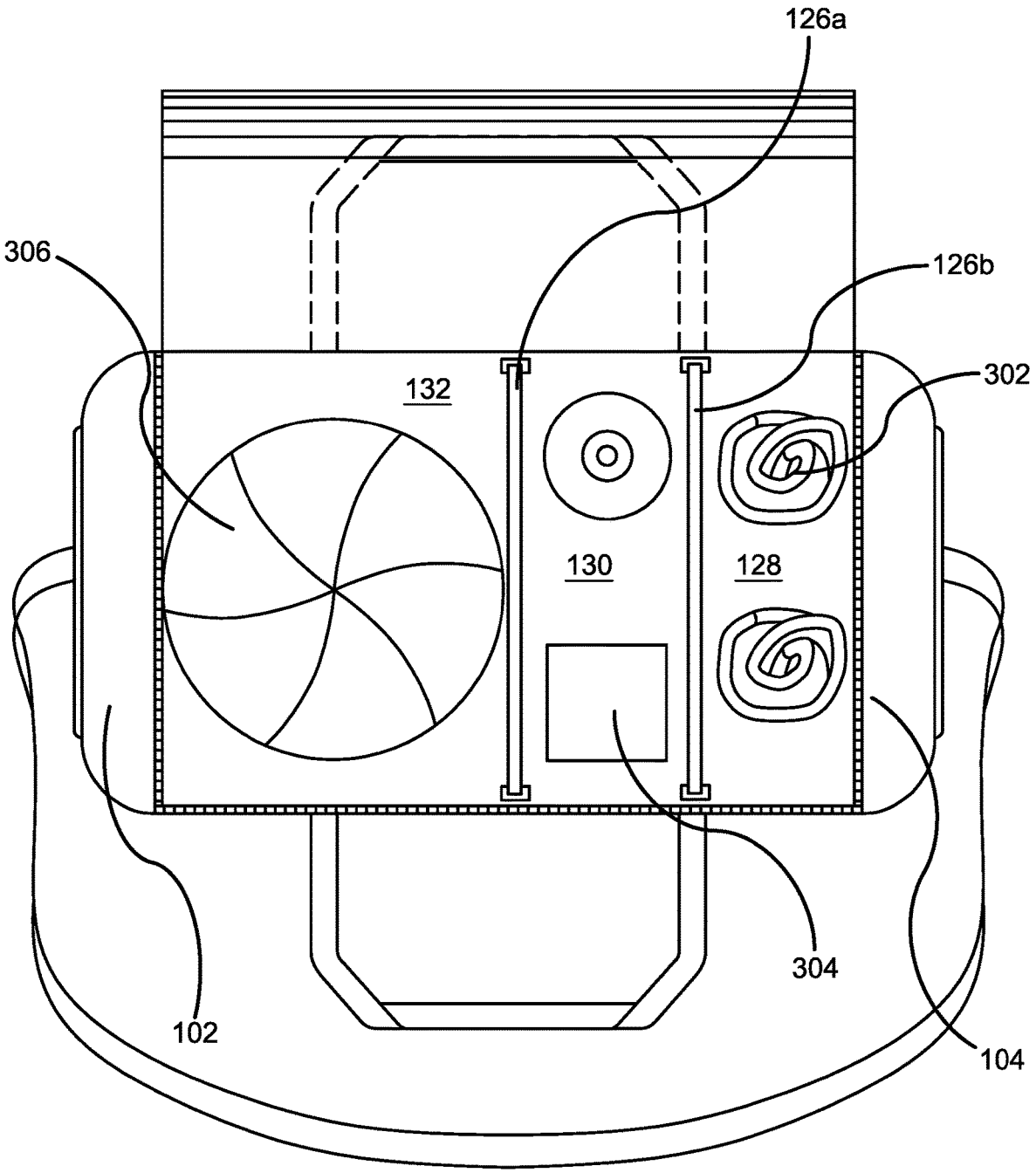
FIG. 3 illustrates a top perspective view of the portable organizer bag of FIG. 1 with items separately stored in compartments formed by the dividers in accordance with the disclosed architecture.

FIG. 3 illustrates a top perspective view of the portable organizer bag 100 of FIG. 1 with items separately stored in compartments formed by the dividers in accordance with the disclosed specification. As illustrated, the first compartment 128 is formed between the side wall 104 and the second divider 126*b* and is used for storing hand towels 302. The second compartment 130 is formed between the first divider 126*a* and the second divider 126*b* and is used for storing clothing 304. The third compartment 132 is formed between the first divider 126*a* and the side wall 102, and has a dimension that is larger than either of the other spaces and, in this embodiment, is wider than the other two compartments 128, 130. For example, the third compartment can be used for storing a ball 306, thereby allowing the user to store the various items in an organized manner and eliminating the need for the user to sift through the interior of the bag to find items and also to separate clean clothes from unsanitary and dirty hand towels 302. Further, it should be noted that the compartments can be configured to any size by placing the dividers as per requirement of the user, and the width can be customized to accommodate different size items.

The fasteners of the dividers and the bag enable a secure and sturdy positioning of the dividers inside the bag 100 and therefore eliminate the worry of mixing items, like clean and dirty clothes inside the bag 100. The fasteners can be hook and loop, adhesive, magnetic, rib and channel, snap or combinations thereof.

Figure 4:
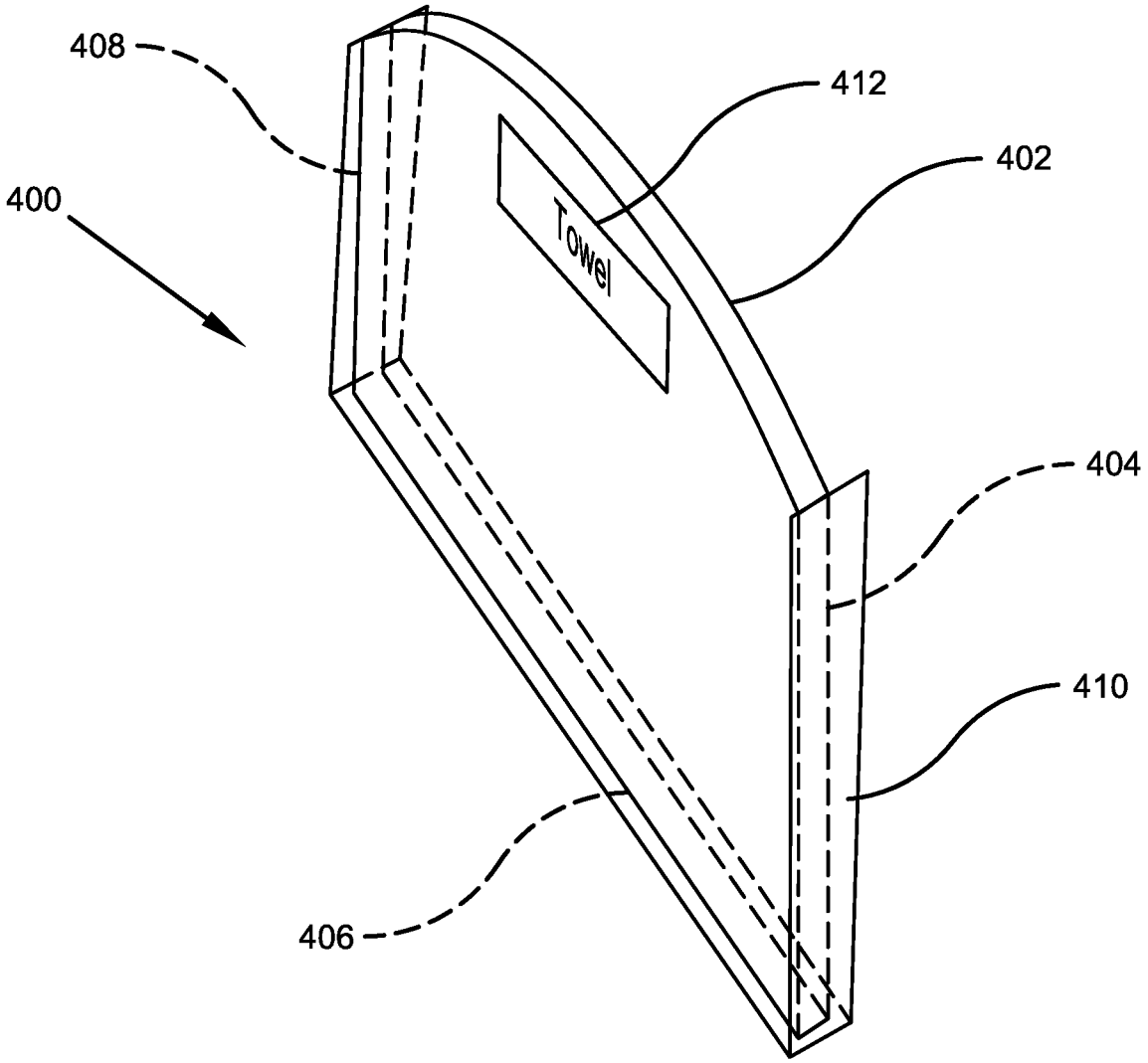
FIG. 4 illustrates a perspective view of an exemplary divider used in the portable organizer bag of the present invention in accordance with the disclosed architecture.

FIG. 4 illustrates a perspective view of an exemplary divider that may be used in the various embodiments of the organizer bag of the present invention in accordance with the disclosed specification. The divider 400 can be used in all embodiments of the organizer bag of the present invention and corresponds to exemplary dividers 126*a*, 126*b* shown in other embodiments.

More specifically, the divider 400 is 1-2 cm thick and has a curved top edge 402 shaped and dimensioned to fit inside an organizer bag. It should be contemplated that the top edge 402 can have any shape like flat, concave, or convex depending on the design and shape of the bag enabling the divider 400 to be placed inside the bag without affecting the space and shape of the bag. The three flat edges 404, 406, 408 have a permanently attached second fastener 410 that allows the divider 400 to secure to the corresponding fastener positioned inside the gym bag.

The flat edges have lengths as per the dimensions of a bag in which the divider 400 is used and further, it should be noted that, a bag can have a fastener disposed on the inner surfaces of the walls and accordingly, the divider 400 can have a corresponding fastener enabling the divider to be securely and stably placed inside the bag.

The divider 400 has a replaceable label 412 that can be used to uniquely identify the divider 400 and the contents stored in a compartment created by the divider 400. The label 412 can be erased and replaced with a new label as per requirements of a user or the plastic pocket may have a rewritable surface. The divider used in the present invention can be made of any of the materials such as plastic, metal, rubber, composite material, or the like.

Figure 5:
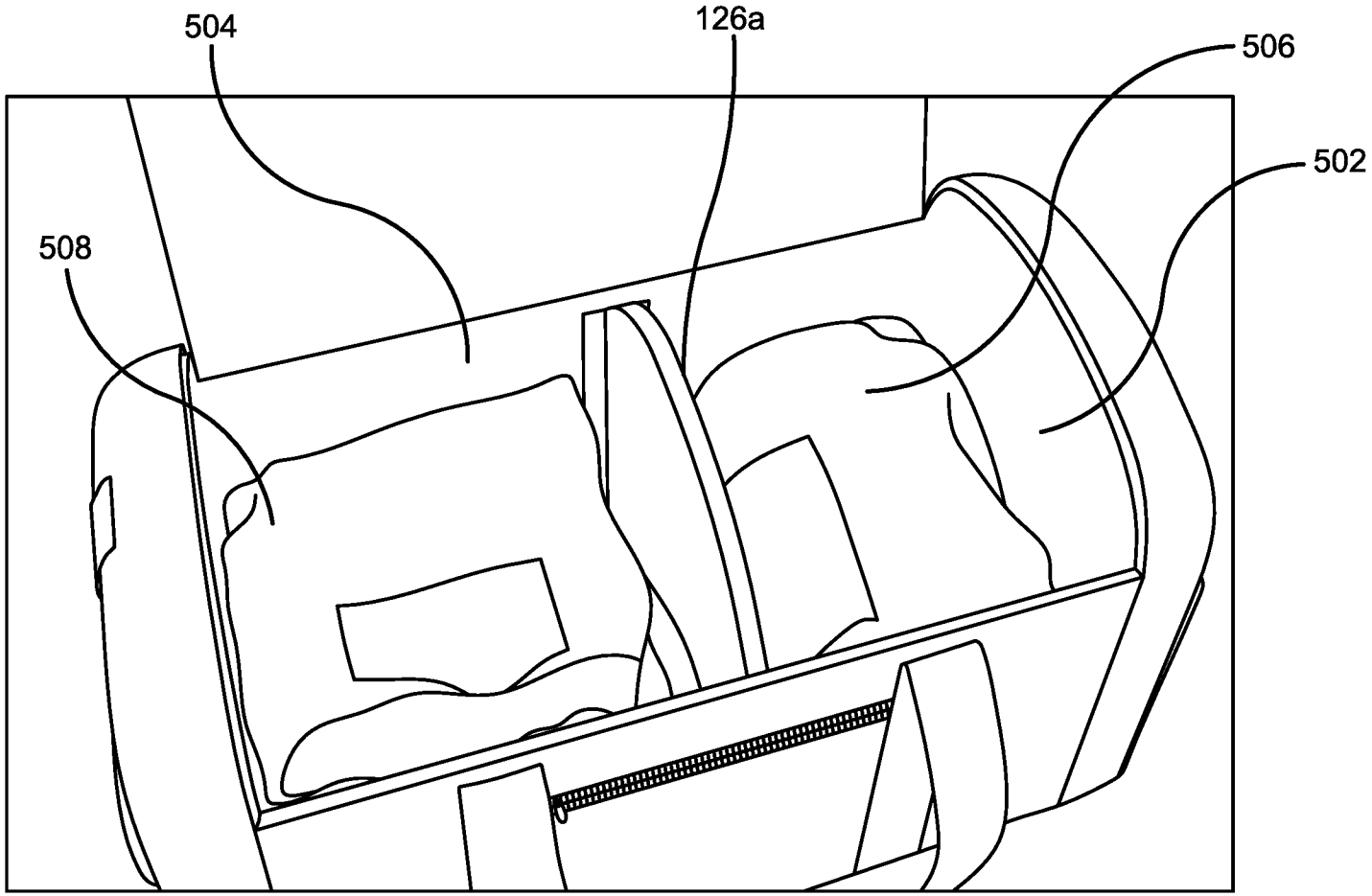
FIG. 5 illustrates a perspective view of the portable organizer bag with a single divider and two compartments in accordance with the disclosed architecture.

FIG. 5 illustrates a perspective view of the organizer bag with a single divider and two compartments in accordance with the disclosed specification. In the present embodiment, the bag 100 of the FIG. 1 is customized to contain a single divider 126*a* to form two equal sized or a first dimensioned compartments 502, 504 to separately store dirty clothes 506 in the compartment 502 and clean clothes 508 in the other compartment 504. Any number of the compartments can be formed by placing the dividers in the bag as per requirements of the users.

The bags of the present invention are portable, easy to carry, and can securely store items in an orderly manner. The bags can also be configured in a wide variety of ways according to the desires of the users. The organizer bags can accommodate any style preference, color, size, or the like to meet requirements of users of all ages and genders.

The principles embodied in the organizer bags of the present invention can be applied to different types and forms of bags, and bags according to embodiments of the invention need not have the same shape, shapes, or range of configurations as the bags 100, 200.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "organizer bag", "portable organizer bag", "bag", and "carry all bag with configurable compartments" are interchangeable and refer to the gym organizer bag 100, 200 of the present invention.

Notwithstanding the foregoing, the gym organizer bag 100, 200 of the present invention can be of any suitable size and configuration as is known in the art without affecting the overall concept of the invention, provided that it accomplishes the above-stated objectives. One of ordinary skill in the art will appreciate that the gym organizer bag 100, 200 as shown in the FIGS. are for illustrative purposes only, and that many other sizes and shapes of the gym organizer bag 100, 200 are well within the scope of the present disclosure. Although the dimensions of the gym organizer bag 100, 200 are important design parameters for user convenience, the gym organizer bag 100, 200 be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A portable bag comprising:

a front wall;

a back wall;

a bottom wall;

a plurality of side walls;

a top panel;

a first fastener thermally fused to and disposed along an entire inner surface of each of the back wall, the front wall, and the bottom wall; and a divider having a second fastener, the second fastener connects with the first fastener to create a compartment with the divider and the front, back, bottom and plurality of side walls; and wherein the divider comprises a label comprising a rewritable and erasable film surface for identifying the divider and associated compartment inside the portable bag;

wherein the divider further comprises a curved top edge configured to not impede closure and opening of the portable bag; and wherein the divider further comprises an anti-fungal coating.

2. The portable bag as recited in claim 1, wherein the first and second fasteners are hook and loop fasteners.

3. The portable bag as recited in claim 2, wherein the first fastener is a loop fastener and the second fastener is a hook fastener.

4. The portable bag as recited in claim 1, wherein the divider is impervious to water or moisture.

5. The portable bag as recited in claim 1, wherein the divider is comprised of a mesh material.

6. The portable bag as recited in claim 1 further comprising at least two dividers to create a plurality of different sized compartments within the portable bag.

7. The portable bag as recited in claim 6, wherein at least one of the plurality of different sized compartments is preconfigured to accommodate a specifically sized item.

8. The portable bag as recited in claim 1 further comprising at least one wheel.

* * * * *